US005552868A

United States Patent [19]

Iwama et al.

[11] Patent Number: 5,552,868

[45] Date of Patent: Sep. 3, 1996

[54] ELECTROPHOTOGRAPHIC DEVICE

[75] Inventors: Ryouichi Iwama, Kawasaki; Syuzo Masuda, Saijo, both of Japan

[73] Assignee: Fujitsu Limited, Kanagawa, Japan

[21] Appl. No.: 506,341

[22] Filed: Jul. 24, 1995

[30] Foreign Application Priority Data

Aug. 29, 1994 [JP] Japan ..... 6-203979

[51] Int. Cl.[6] ..... G03G 15/08

[52] U.S. Cl. ..... 355/245; 355/215; 355/251; 118/656

[58] Field of Search ..... 355/245, 251, 355/253, 259, 215; 118/656–658

[56] References Cited

U.S. PATENT DOCUMENTS 5,202,729 4/1993 Miyamoto et al. ..... 355/251

5,321,473 6/1994 Azami ..... 355/245

5,461,465 10/1995 Sunaga et al. ..... 355/245

5,488,462 1/1996 Ishikawa et al. ..... 355/215

*Primary Examiner*—R. L. Moses

*Attorney, Agent, or Firm*—Armstrong, Westerman, Hattori, McLeland & Naughton

[57] ABSTRACT

This invention relates to an electrophotographic device in which a latent image is formed on a recording drum by toner material. The invention prevents unused toner from being attached to the recording drum so that the quality of an image formed can be improved. In this invention, a carriage is conveyed in a perpendicular direction to a feeding direction of recording paper for printing thereon. A developing roller of a developing device mounted in a process portion is wider than an effective imaging area of the recording drum and is narrower than a charged area thereof. Also, sealing members can be provided at both end surfaces of the developing roller.

20 Claims, 9 Drawing Sheets

ELECTROPHOTOGRAPHIC DEVICE

BACKGROUND OF THE INVENTION

1. Field of the Invention

The present invention generally relates to electrophotographic devices, and more particularly to an electrophotographic device in which a toner latent image is formed on a recording drum for imaging.

Currently, there is a demand for economical and small-size electrophotographic devices. Thus, a serial-type electrophotographic printer in which an electrophotographic unit is mounted in a carriage has been developed. In this type of electrophotographic printer, an image is transcribed on recording paper by a carriage being conveyed in a perpendicular direction to a feeding direction of the recording paper. The transcribed image is fixed by a photographic fixing device provided in the feeding direction of the recording paper. In this type of electrophotographic printer, an improvement in the quality of the recorded image is desired.

2. Description of the Prior Art

FIG. 1A is a partial plan view of a conventional serial-type electrophotographic printer and FIG. 1B is a sectional view showing a carriage thereof.

A serial-type electrophotographic printer 11 shown in FIGS. 1A and 1B is disclosed in Japanese Laid-Open patent Application No. 56-152463. The serial-type electrophotographic printer 11 is equipped with feeding rollers 13*a*, 13*b* for feeding recording paper 12 and a shaft 14 parallel to the feeding rollers 13*a*, 13*b*. A removable carriage 15, guided by the shaft 14, is provided in a perpendicular direction to the feeding direction of the recording paper 12. The carriage 15 is conveyed by a driving motor (not shown). At a downstream side in the feeding direction of the recording paper 12, there is provided a photographic fixing device 16, which is longer than the width of the recording paper 12. Also, a transcription device 17 is provided under the recording paper 12 in the feeding direction of the recording paper 12.

A drum-shaped image carrier (hereinafter simply referred to as drum) 21, which rotates at a circumferential speed in synchronism with movement of the carriage 15, is mounted in the carriage 15. A circumferential surface of the drum 21 is uniformly charged by a charging device 22 and an electrostatic latent image is formed thereon by an exposing device 23. The electrostatic latent image is made into a visible toner image by toner 25 in a developing device 24. The toner 25 is applied by a developing roller 26. The toner image is transcribed to the recording paper 12 by the transcription device 17 which faces the drum 21 on the opposite side of the recording paper 12. The transcribed portion is photographically fixed by the photographic fixing portion 16.

In this serial-type electrophotographic device 11, feeding of the recording paper is an intermittent action. Accordingly, the fixed image quality is different when the recording paper is being fed from that when the recording paper is stopped. This operation prevents a uniform fixing quality from being achieved. For example, part of the recording paper in contact with the fixing roller when the fixing roller is stopped has a glossy appearance.

In order to solve the above problem, a serial-type electrophotographic device has been developed in which a photographic fixing roller is provided in a carriage.

FIG. 2 is a schematic illustration showing a carriage in which a photographic fixing device is provided. A carriage 15 having a photographic fixing device 27 is disclosed in Japanese Laid-Open Utility Model Application No. 61-145649. In the carriage 15, a cleaner 30 is provided in order to remove toner particles remaining on the drum 21 after a printing cycle.

In the photographic fixing device 27, a fixing roller 28 is provided which rotates in the same direction as the drum 21. In the fixing roller 28, a heat source 29 (i.e. a halogen lamp) is provided. The fixing roller 28 is heated by the heat source 29 before a printing operation and the temperature thereof is detected and controlled by a temperature sensor (not shown) such as a thermistor. That is, the fixing device 27 is conveyed with the drum 21 in order to conduct the photographic fixing subsequent to the transcription of the image.

Since the transcription by the transcription device 17 is conducted by applying a prescribed electric voltage between the transcription device 17 and the drum 21, an electrically conductive material, such as electrically conductive gum, is applied on a baseboard in the photographic fixing device 17.

However, in the serial-type electrophotographic printer described above, when the carriage having an imaging unit is conveyed on the recording paper 12, the toner 25 in the developing device 24 may possibly overflow onto the recording paper 12 or the toner 25 deposited at both edges of the developing roller 26 may possible fall on the recording paper 12. This toner residue degrades the image quality.

Also, when the toner 25, deposited on both edges of the developing roller 26, is transferred to the recording drum 21, the toner 25 is gradually deposited on the charging device 22 which contacts the recording drum 21. Part of the charging device 22 on which the toner 25 is deposited cannot have a charging function. Therefore, lines are printed on the recording paper. In this case also, the image quality is degraded.

SUMMARY OF THE INVENTION

Accordingly, it is a general object of the present invention to provide a novel and useful electrophotographic device in which the above disadvantages are eliminated.

A more specific object of the present invention is to provide an electrophotographic device in which an image quality can be improved by preventing the unused toner from being attached to the recording paper.

The above objects of the present invention are achieved by an electrophotographic device comprising, feeding means for feeding a recording paper, process means, having an image carrier and a developing device, for forming a latent image on the image carrier and developing said latent image to a visible image by image material through said developing device, transcription means for transcribing the visible image to the recording paper, photographic fixing means for fixing the image transcribed to the recording paper, wherein the developing device contacts the image carrier to develop the visible image by the image material, the developing device having a developing member wider than at least an effective imaging area of the image carrier and narrower than a charged area of the image carrier.

In the above invention, the developing member can have a contacting portion for adjusting a thickness of the image material supplied thereon, the contacting portion being wider than the developing member. In the above invention, the contacting portion can be laterally displaced to a side of the developing member which is opposite to the image carrier.

According to the above inventions, the unused toner is prevented from being attached to the image carrier except to the effective imaging area of the image carrier. Therefore, the image quality can be improved.

The above invention can further have sealing members for preventing part of the image material which contacts an end portion of the developing member from overflowing, the sealing members being provided at both ends of the developing material. In the above invention, each of the sealing members can have a projecting portion for adjusting an amount of the image material to be supplied to the developing device, the projecting portion being provided adjacent the contacting portion. According to the above inventions, the sealing member or the projecting portion prevents the toner from being overflown or controls the amount of the toner supplied. Therefore, the useless toner is prevented from being supplied to the image carrier and the image quality is improved.

The above invention can further have agitating members for agitating the image material which overflows from both end surfaces of the developing member, the agitating members being provided at the both end surfaces of the developing member. According to the above inventions, the agitating members prevent the toner from being attached to both end surfaces of the developing member. Therefore, the unused toner is prevented from being supplied to the image carrier and the image quality is improved.

The above invention can further have a space portion for depositing part of the image material overflow from the both end surfaces of the developing member, the space portion formed under the developing member. In the above invention, the space portion can be laterally displaced to a side of the developing member which is opposite to the image carrier. According to the above inventions, the unused toner is stored in the space portion and the toner is returned to the area in which the toner is originally stored. Therefore, the unused toner is prevented from being supplied to the image carrier and the image quality is improved.

The above invention can have transferring means for transferring part of the image material deposited in the space portion to an area in which the image material is originally stored. In the above invention, the transferring means and the developing member are in synchronism with each other, the electrophotographic device further comprising a rotating member for transferring the image material to the developing member. According to the above inventions, the transferring means returns the unused toner to the original portion. Therefore, the unused toner is prevented from being supplied to the image carrier and the image quality is improved.

The above invention can further have a carriage for mounting the process means and conveyer means for conveying the carriage in a perpendicular direction to the feeding direction of the recording paper on the transcription means. In the above invention, the photographic fixing means is mounted on the carriage. According to the above inventions, the present invention can be utilized in serial-type electrophotographic devices.

Other objects and further features of the present invention will be apparent from the following detailed description when read in conjunction with the accompanying drawings.

DESCRIPTION OF THE PREFERRED EMBODIMENTS

The preferred embodiments of the present invention will now be described in further detail with reference to the accompanying drawings.

Figure 1A:
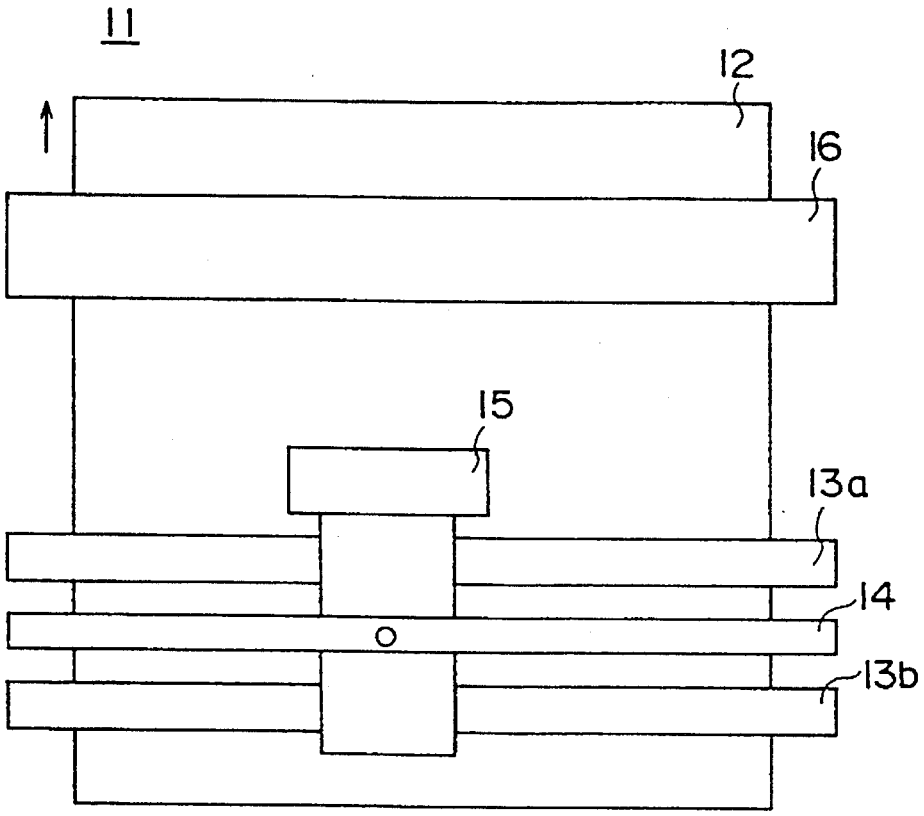
FIG. 1A PRIOR ART
FIG. 1A is a partial plan view of a conventional serial-type electrophotographic printer.
Figure 1B:
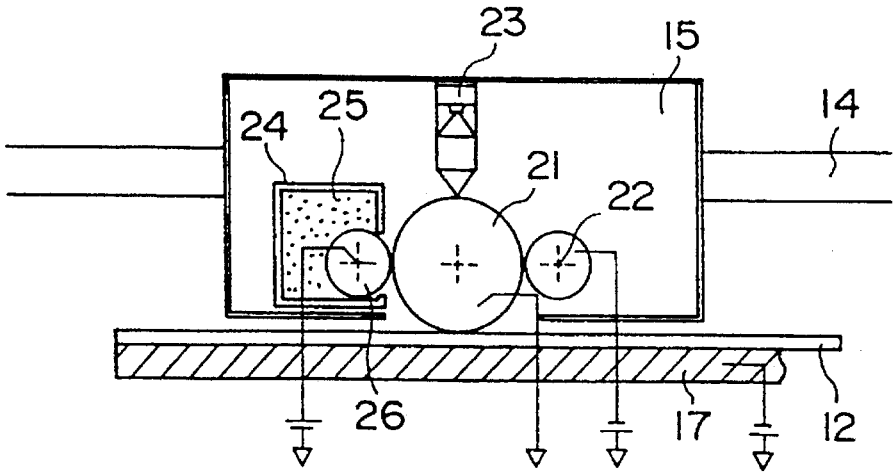
FIG. 1B PRIOR ART
FIG. 1B is a sectional view showing a carriage used in the conventional serial-type electrophotographic printer.
Figure 2:
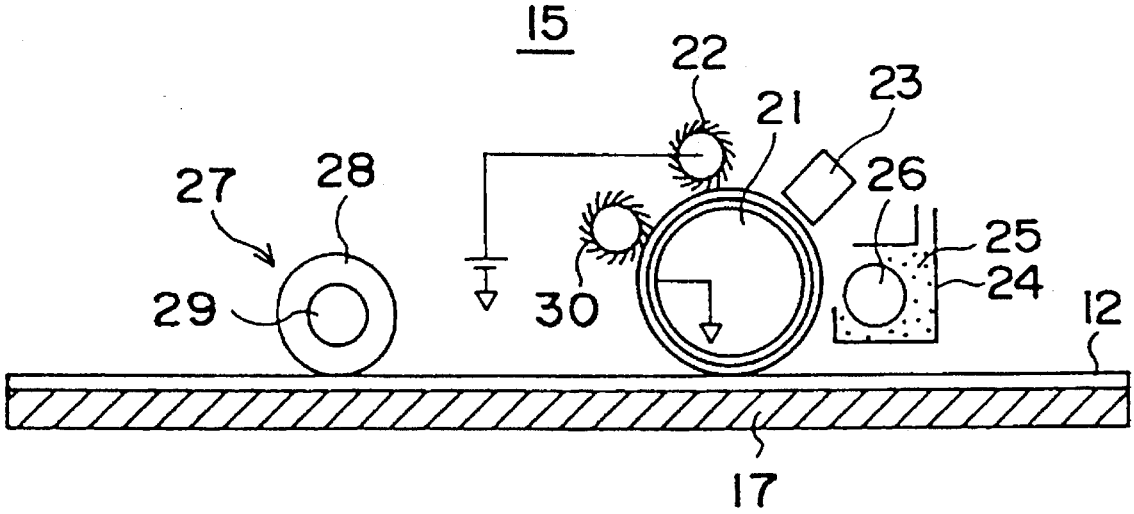
FIG. 2 PRIOR ART
FIG. 2 is a schematic illustration showing a carriage having a photographic fixing device.
Figure 3A:
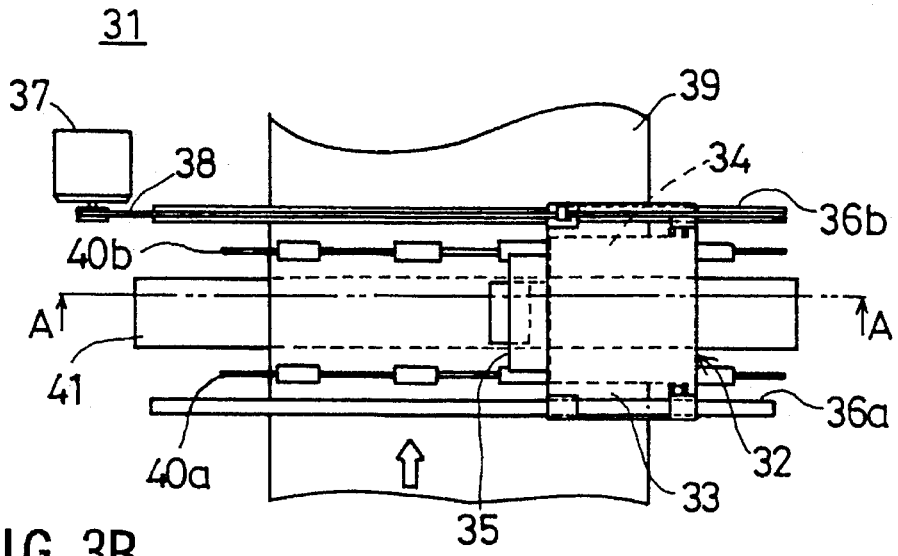
FIG. 3A is a plan view showing a first embodiment of the present invention.
Figure 3B:
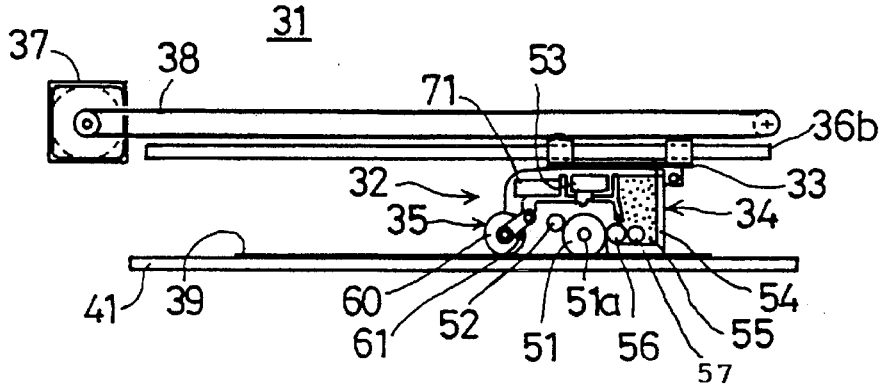
FIG. 3B is a sectional view taken on line A—A.
Figure 3C:
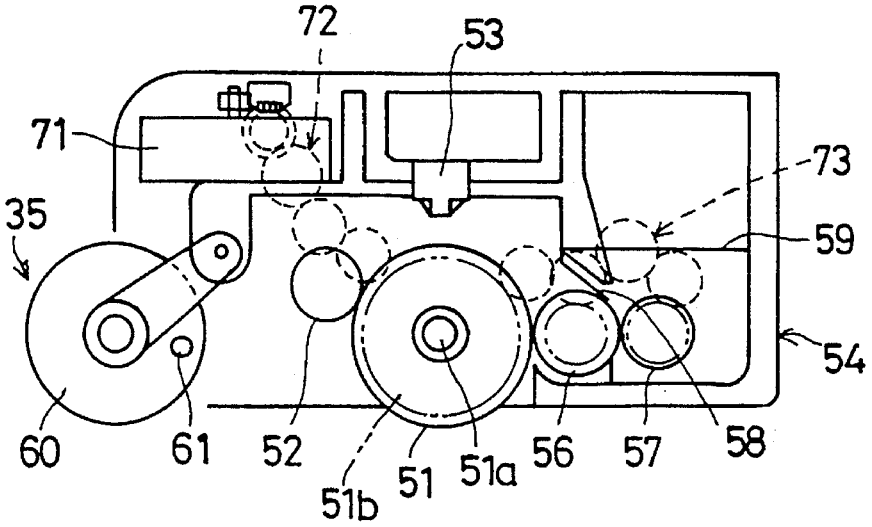
FIG. 3C is an enlarged sectional view showing a carriage.

FIG. 3A is a plan view showing a first embodiment of the present invention, FIG. 3B is a sectional view taken on line A—A of FIG. 3A and FIG. 3C is an enlarged sectional view showing a carriage.

In FIGS. 3A, 3B and 3C, a serial-type electrophotographic printer 31 has a carriage 32. The carriage 32 comprises a slide portion 33, a process portion 34 defining process means and a fixing portion 35 defining fixing means. The process portion 34 and the fixing portion 35 are mounted on the slide portion 33.

Recording paper 39 is fed in a direction shown by an arrow P in FIG. 3A by rotating shafts 40*a*, 40*b* defining feeding means. The slide portion 33 is guided by guide shafts 36*a*, 36*b*, and is conveyed in a perpendicular direction to the feeding direction of the recording paper 39 by a carrier motor 37 through a belt 38.

Under the carriage 32, a transcription device (transcription platen) 41 is arranged in a conveying direction of the carriage 32. The transcription device 41 comprises a baseboard of, for example, aluminum and a heat-resistant material (i.e. silicone gum including a conductive material) applied on a carriage side surface of the baseboard. The recording paper 39 is fed between the transcription device 41 and the carriage 32.

In the process portion 34 of the carriage 32, a recording drum 51 having a rotational axis 51*a*, parallel to the feeding direction of the recording paper 39, is provide as an image carrier, as shown in FIG. 3B. The recording drum 51 rotates in coordination with the speed of the carriage 32 on the recording paper 39 as the paper is fed across the transcription device 41.

On the entire surface of the recording drum 51, an exposure layer (i.e. organic exposure layer or amorphous silicon) is formed. The exposure layer is uniformly charged by a charging device 52. An electrostatic latent image is formed on the exposure layer by an exposure element (LED) 53 as exposure means provided above the recording drum 51. The electrostatic latent image is developed into a visible image by toner 55, as image material, stored in the developing device 54 as developing means. The toner 55 is supplied to the recording drum 51 by a developing roller 56. The toner image is transcribed on the recording paper 39 by applying a prescribed electric voltage between the recording drum 51 and the transcription device 41 facing the recording drum 51 through the recording paper 39. The developing roller 56 rotates in coordination with the recording drum 51.

The developing device 54 has a supply roller 57 for supplying the toner 55 to the developing roller 56. The developing device has a blade of, for example, stainless steel for contacting the developing roller 56 to adjust the amount of the toner 55 retained on the developing roller 56. At both edges of the developing roller 56, sealing members 59 are provided in order to prevent the toner from overflowing. The sealing members 59 contact the developing roller 56, as shown in FIG. 3C and FIGS. 4A and 4B.

In the fixing portion 35 mounted on the carriage 32 with the process portion 34, a photographic fixing roller 60 is provided with a halogen lamp 60*a* as heating means. The fixing roller 60 is made of magnetic material such as iron and the surface thereof is coated with a protective material. The fixing roller 60 has a thermistor 61 as temperature detecting means and is maintained at a prescribed temperature.

When the carriage 32 is conveyed in the perpendicular direction to the feeding direction of the recording paper 39 in the serial-type electrophotographic printer 31, an image transcription by the process portion 34 and a photographic fixing by the photographic fixing roller 60 of the photographic fixing portion 35 are conducted in the direction shown by the arrow. When the carriage 32 returns to its original position, the image is not formed. That is, during a round trip of the carriage 32, one line of image is formed on the recording paper 39. A prescribed amount of the recording paper which corresponds to one line of the image is fed by the driving rollers 41*a*, 41*b*.

Figure 4A:
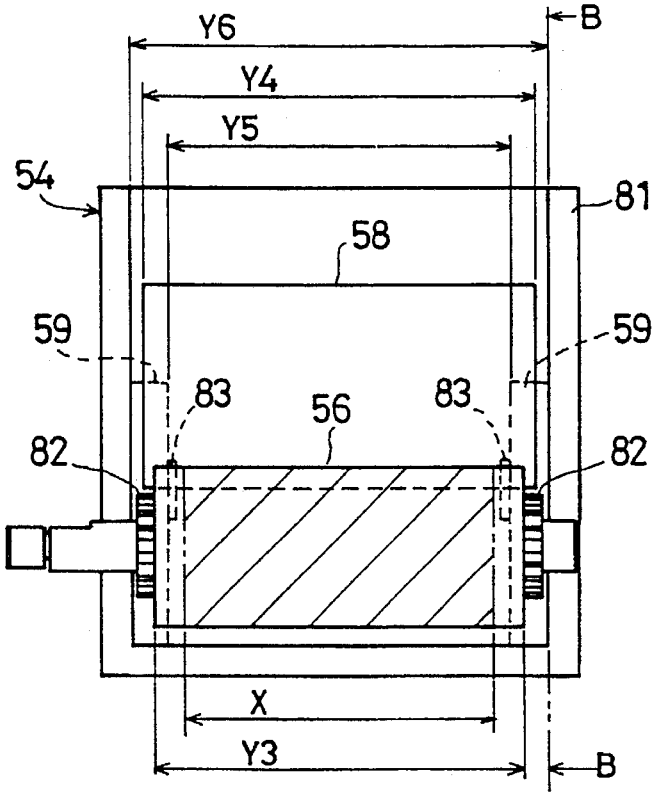
FIG. 4A is a front view showing a developing device shown in FIG. 3B.
Figure 4B:
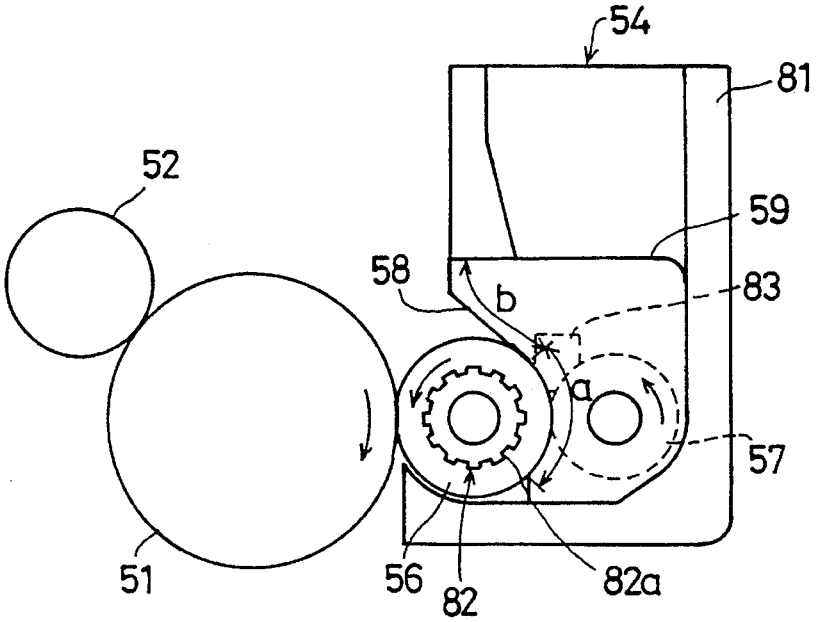
FIG. 4B is a sectional view taken on line B—B of FIG. 4A.

FIGS. 4A and 4B are enlarged views showing the developing device shown in FIG. 3B, in which FIG. 4A is a front view and FIG. 4B is a sectional view taken on line B—B of FIG. 4A.

In the developing device 54 shown in FIGS. 4A and 4B, the developing roller 56 which contacts the blade 58 contacts the supply roller 57 in a developing frame 81. The sealing members 59 are provided at the both edges of the developing roller 56 to cover the supply roller 57.

At both edges or ends of the developing roller 56, agitating rollers 82 defining agitating means are provided coaxially to the developing roller 56. The agitating roller protrudes from both edges of the developing roller 56. On a circumference of the agitating member 82, an irregular portion 82*a* is provided. In the sealing member 59, projecting portions 83 are provided to contact the developing roller 56 and the supply roller 57.

In the developing device 54, the blade 58 has a width Y4, the developing roller 56 has a width Y3 which is narrower than the width Y4, the sealing members 59 are provided at an interval Y5 which is narrower than the width Y3 of the developing roller 56, the projecting portions 83, which do not interfere with the effective imaging area X of the developing roller 56 are provided in the developing frame at a width Y6.

Figure 5A:
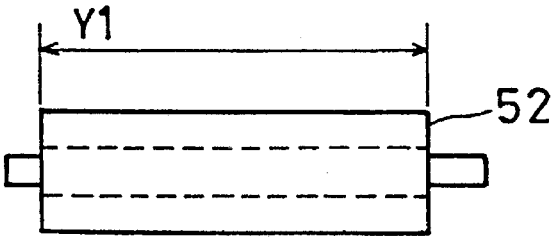
FIG. 5A is a plan view showing a charging roller.
Figure 5B:
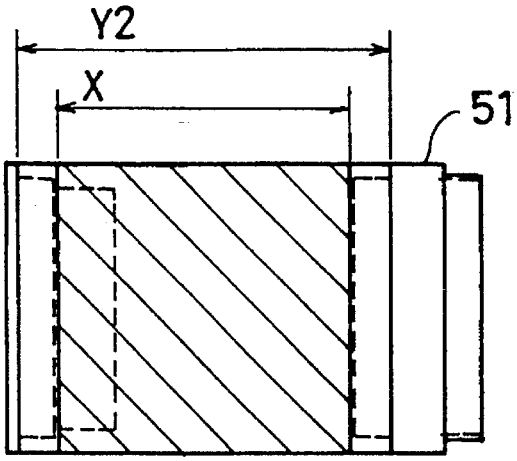
FIG. 5B is a plan view showing a recording drum.
Figure 5C:
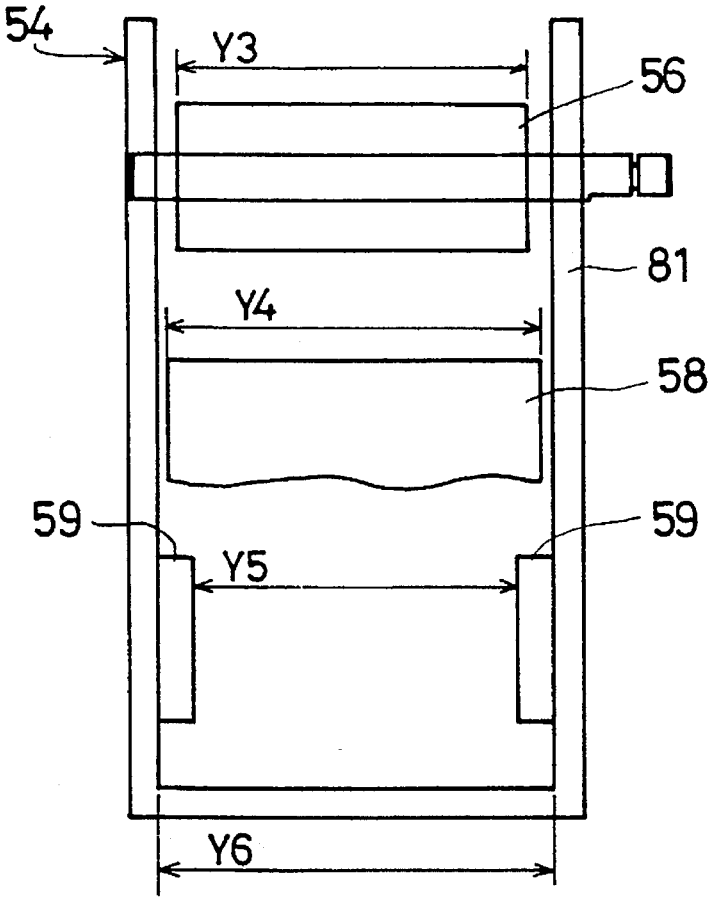
FIG. 5C is a plan view showing a developing roller, a blade, sealing member and developing frame.

FIGS. 5A, 5B and 5C are schematic illustrations showing a relation in size between the parts described above. More particularly, FIG. 5A is a plan view showing the charging roller 52, FIG. 5B is a plan view showing the recording drum 51, FIG. 5C is a plan view showing the developing roller 56, the blade 58, the sealing member 59 and the developing frame 81.

In FIGS. 5A, 5B and 5C, Y1 represents a width of the charging roller 52, Y2 represents a width of the recording drum 51, Y3 represents the width of the developing roller 56, Y4 represents the width of the blade 58, Y5 represents then interval of the sealing members 59, Y6 represents the width of the developing frame and X represents the width of the effective imaging area of the developing roller 56.

Each of the above widths has the relationship described in the following equations.

$X<Y5<Y3<Y4<Y6$ $X<Y3\leqq Y2<Y1$ $Y6<Y2$

An overlapping amount of the sealing member 59 and the developing roller 56 is (Y4-Y5)/2 and the sealing members 59 contact the blade 58 within an area shown by an arrow b in FIG. 4B in the developing device 54. Also, the width Y4 of the blade is wider than the width Y5 of the developing roller Y5 (Y4 >Y5).

Next, an overflow of the toner 55 will be described below.

Figure 6:
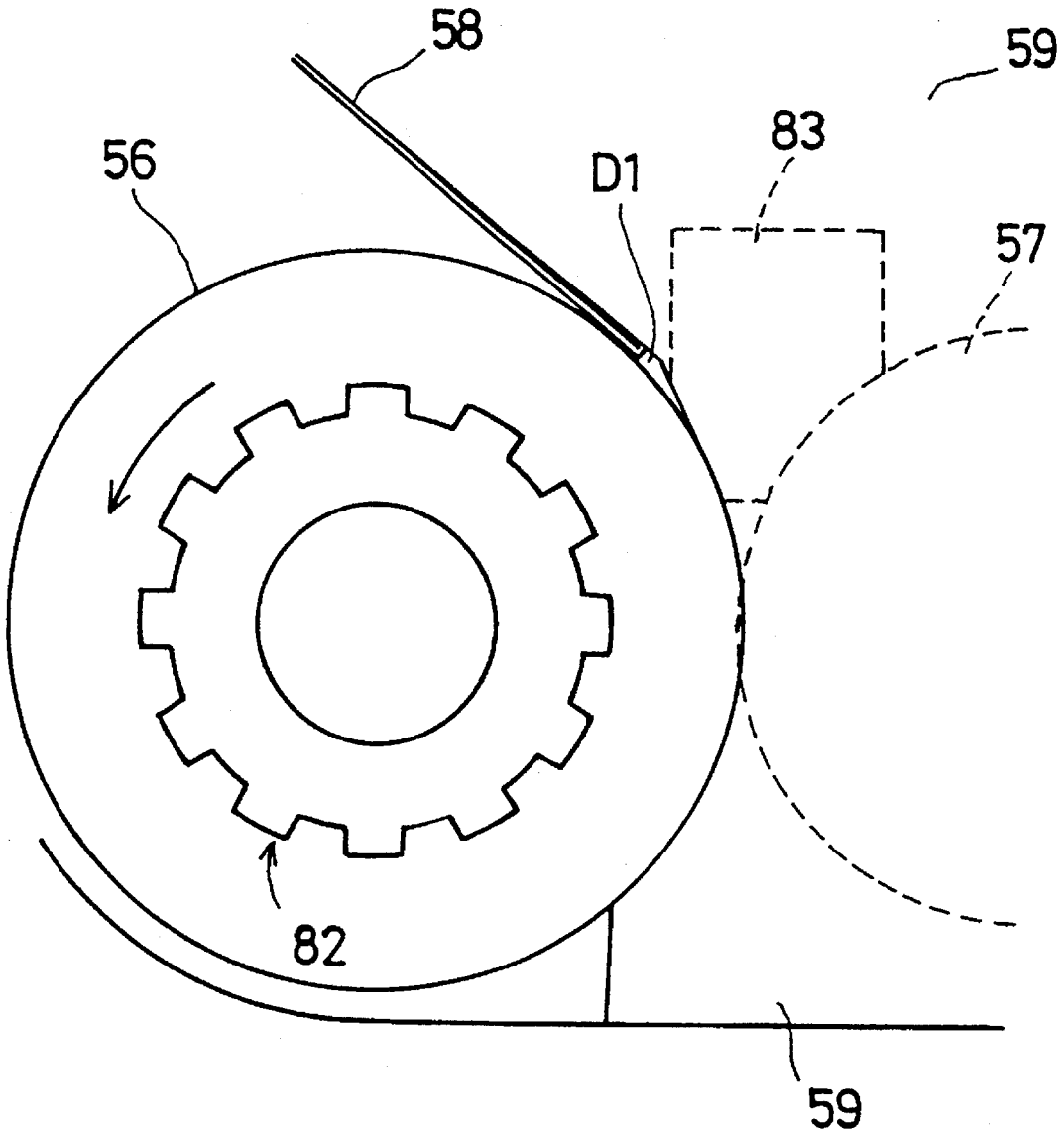
FIG. 6 is an enlarged sectional view showing a developing roller shown in FIG. 2.

FIG. 6 is an enlarged sectional view showing the developing roller shown in FIG. 4. In FIG. 6, the toner 55 is supplied to the developing roller 56 by the supply roller 57 between the sealing members 59. Between the sealing members 59, the developing roller 56 and the blade 58, a small-size gap D1 is formed from which toner overflows to the whole surface of the developing roller 56.

An area of the recording drum 51 to which the toner 55 is supplied is shown by an arrow X in FIG. 4A. The toner existing in an area shown by Y3-X of the recording drum must be prevented from being transferred to the recording drum 51.

The toner 55 is prevented from being supplied to the recording drum 51 by the charging area Y2 of the recording drum 51 being wider than the width Y3 of the developing roller 56. That is, the photosensitive layer of toner is applied on the whole surface of the recording drum 51 having a width Y2. The width of the charging roller 52 is wider than the width Y2 of the recording drum on which the photosensitive layer is applied in order to make the whole surface of the recoding drum 51 the charged area by the charging roller 52. According to the structure described above, the recording drum 51 can be reduced in size to the developing roller 56 and the electrophotographic device 31 can be miniaturized.

The width Y3 of the developing roller 56 is designed to be narrower than the width Y4 of the blade 58. The reason is that if the width Y4 is narrower than the width Y3 of the developing roller 56 (Y3>Y4), the edge face of the blade 58 contacts the developing roller 56. Therefore, if the developing roller 56 continues to rotate, the contacting portion will be ground. In this embodiment, the toner 55 remaining on the recording drum 51 is collected by the developing roller 56 and the cleaning portion is omitted. Accordingly, when the developing roller 56 is grounded, the toner 55 remaining on the recording drum 51 cannot be collected. In this case, the image quality is deteriorated. Also, the toner 55 is attached to the charging roller, which prevents the charging roller from being charged. This is one of the factors which deteriorate the image quality. Further, when burrs are formed at the edge portion of the blade 58, this also increases degradation of image quality. In this embodiment, the unused toner 55 is prevented from being remained on the recording drum 51 and the image quality can be improved by the structure described above.

Figure 7A:
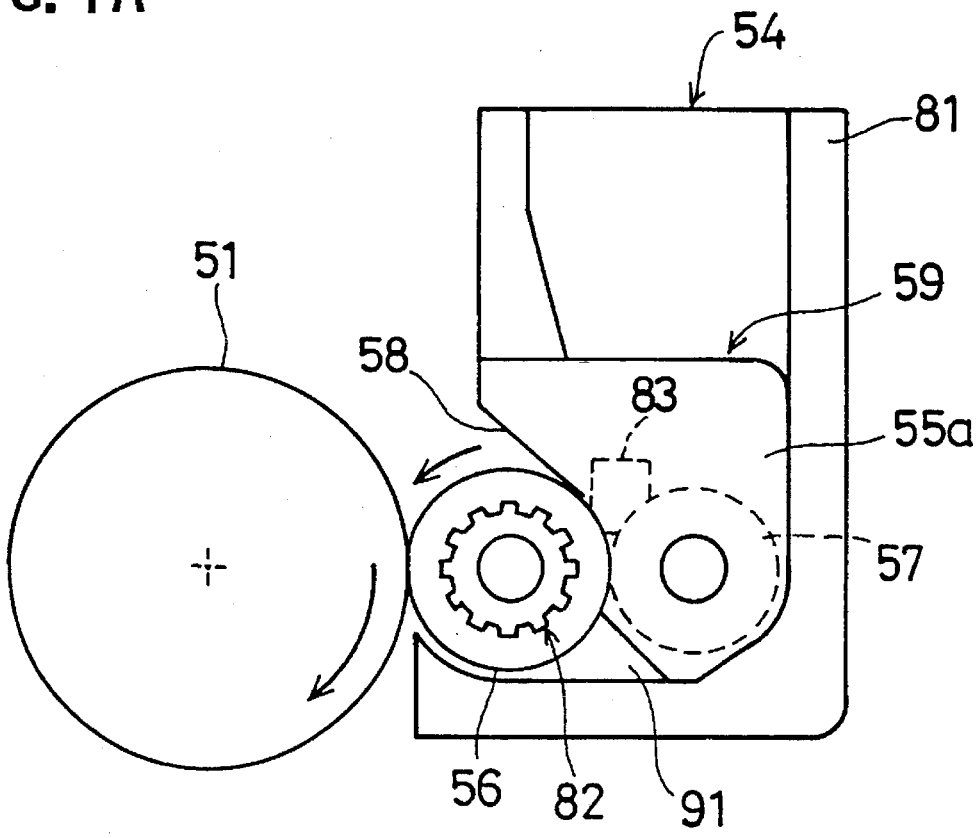
FIG. 7A is an enlarged sectional view showing a developing device of a second embodiment of the present invention.
Figure 7B:
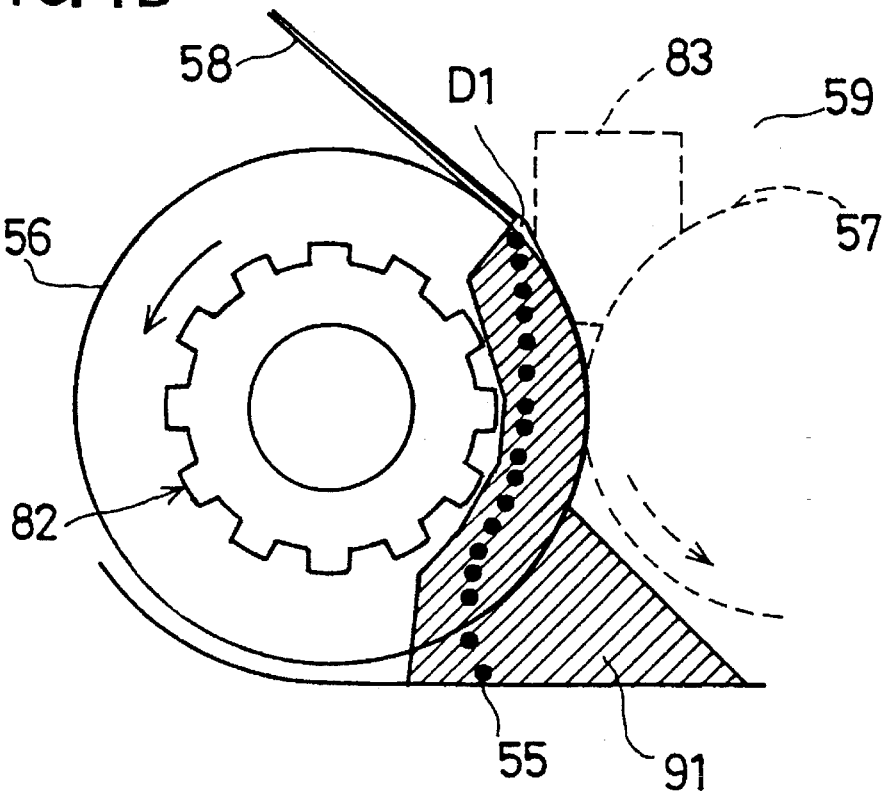
FIG. 7B is an enlarged sectional view showing a developing roller.

FIGS. 7A and 7B are schematic illustrations showing a second embodiment of the present invention, in which FIG. 7A is an enlarged sectional view showing a developing device of an electrophotographic device and FIG. 7B is an enlarged sectional view showing a developing roller thereof.

In the following embodiments, the same features previously described in the first embodiment are denoted by the same reference numerals and the descriptions thereof are omitted.

In the above description of the first embodiment, the gap D1 is formed between the developing roller 56, the blade 58 and the sealing members 59, from which the toner 55 overflows to both end surface of the developing roller 56. In some cases, the toner 55 is overflown to the both edge surfaces of the developing roller 56 from the gap D1. When the deposited toner 55 is attached to the recording drum 51, the image formed is deteriorated. Therefore, the toner must be collected or returned to a toner room 55a of the developing device 54.

In the developing device 54 of the second embodiment, a space portion 91 is formed under the developing roller 56 and the supply roller 57 at the supply roller 57 side of the rotation center of the developing roller 56, as shown in FIG. 7A. That is, the width Y3 of the developing roller 56 shown in FIG. 4B is designed to be narrower than the width Y6 of the developing frame 81 in order to form the space portion 91 of a width (Y6-Y3)/2. In order to provide an enlarged space portion 91, parts of the sealing members 59 are cut out.

In this embodiment, the toner 55 overflows to both edges of the developing roller 56 from the gap D1, is collected in a space portion 91, and returned to the toner room or storage 55*a* by the supply roller 57 rotating as shown in FIG. 7B. In this case, the agitating member 82 provided at both edges of the developing roller 56 agitates the toner 55 in order to prevent the toner 55 from being retained on the edge faces of the developing roller 56. The blade 58 is set so as that the gap D1 is positioned at the supply roller 57 side from the rotation axis of the developing roller 56. The projecting amount of the projecting portions 83 formed in the sealing member 59 is designed to be between the effective imaging width X and the width of the sealing member 59 in order to reduce the amount of the toner 55 supplied to the gap D1.

Figure 8A:
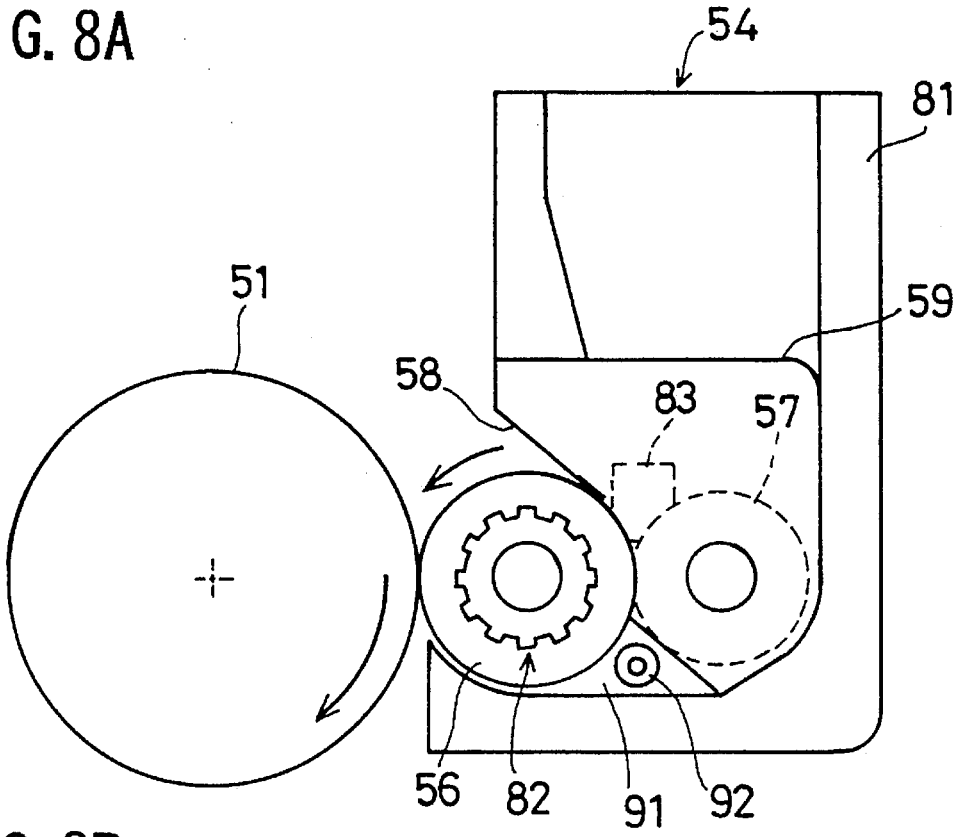
FIG. 8A is a sectional view showing a variation of the developing device of the electrophotographic device of the second embodiment.
Figure 8B:
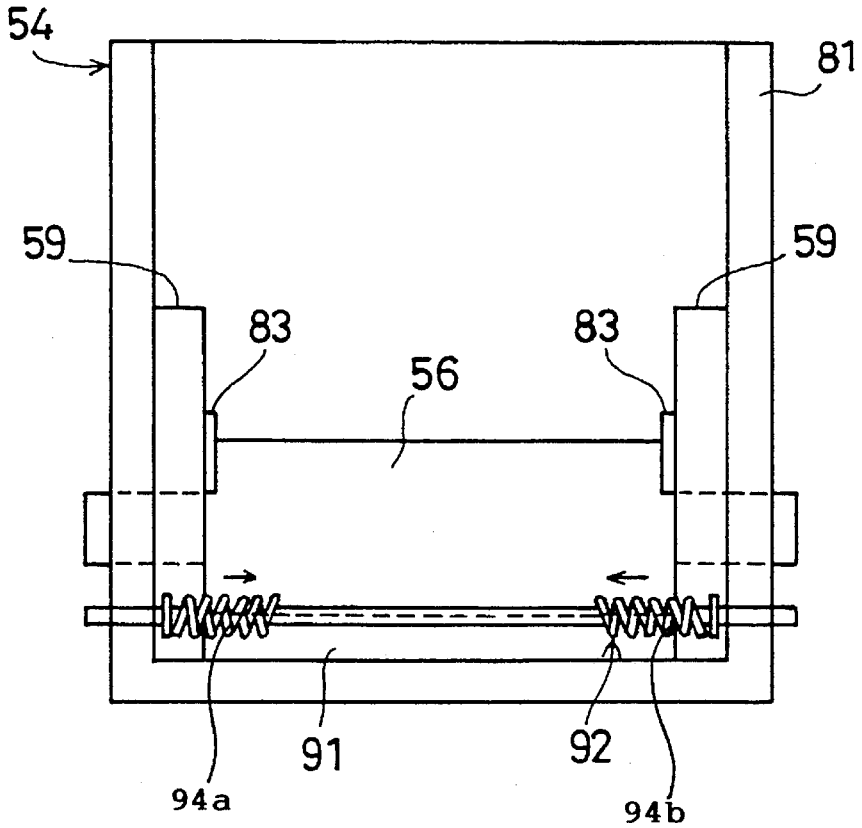
FIG. 8B is a front view showing the variation of the developing device of the electrophotographic device of the second embodiment.

FIGS. 8A and 8B are schematic illustrations showing a variation of the second embodiment in which FIG. 8A is a sectional view showing a developing device of the electrophotographic device and FIG. 8B is a front view showing thereof.

In FIG. 8A, a toner transferring member 92 is provided in the space portion 91 to transfer the toner 5 which overflows into the space portion 91 to the supply roller 57. Other features are the same as those previously shown in FIGS. 7A and 7B. In the toner transferring member 92, screws 94*a*, 94*b* are provided on a shaft 93 which rotates in coordination with the rotation of the developing roller 56. Each of the screws 94*a*, 94*b* has a different direction of twist. The overflow toner deposited in the space portion 91 can be returned to the toner room or storage container 55*a* by the screws 94*a*, 94*b* moving in directions shown by arrows in FIG. 8B. According to the developing device shown in FIGS. 8A and 8B, the overflow toner is prevented from remaining on the recording drum 51 and being redeposited by the developing roller 56. Therefore, the image quality can be improved.

Figure 9A:
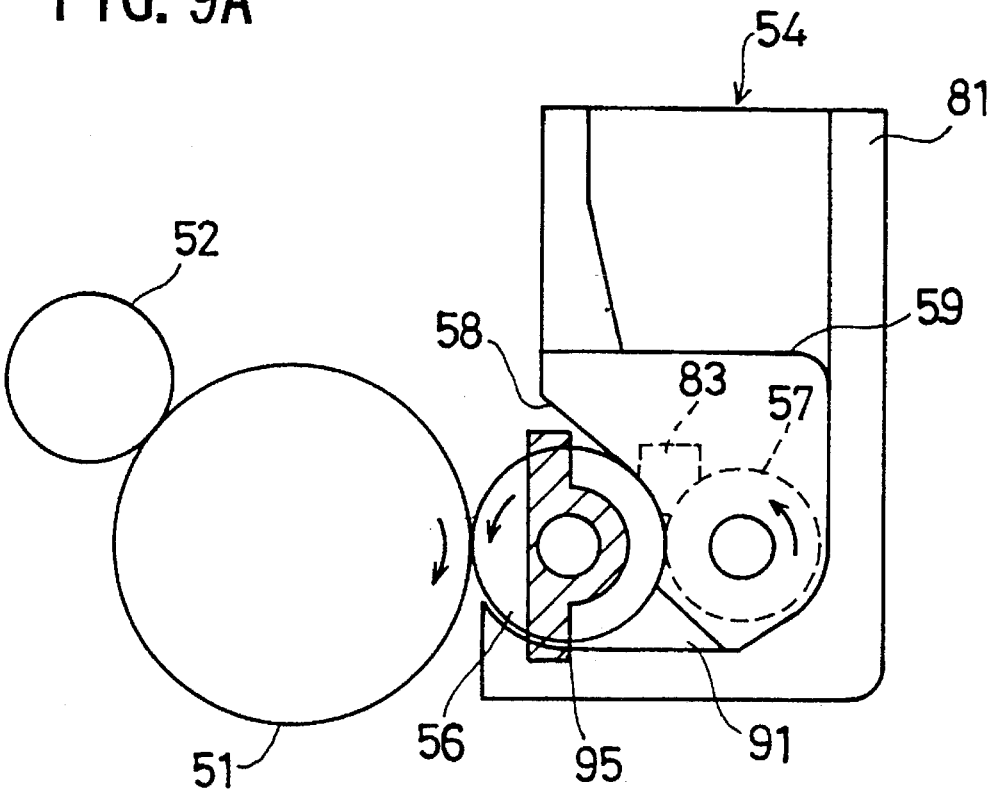
FIG. 9A is a sectional view showing a developing device of an electrophotographic device of a third embodiment.
Figure 9B:
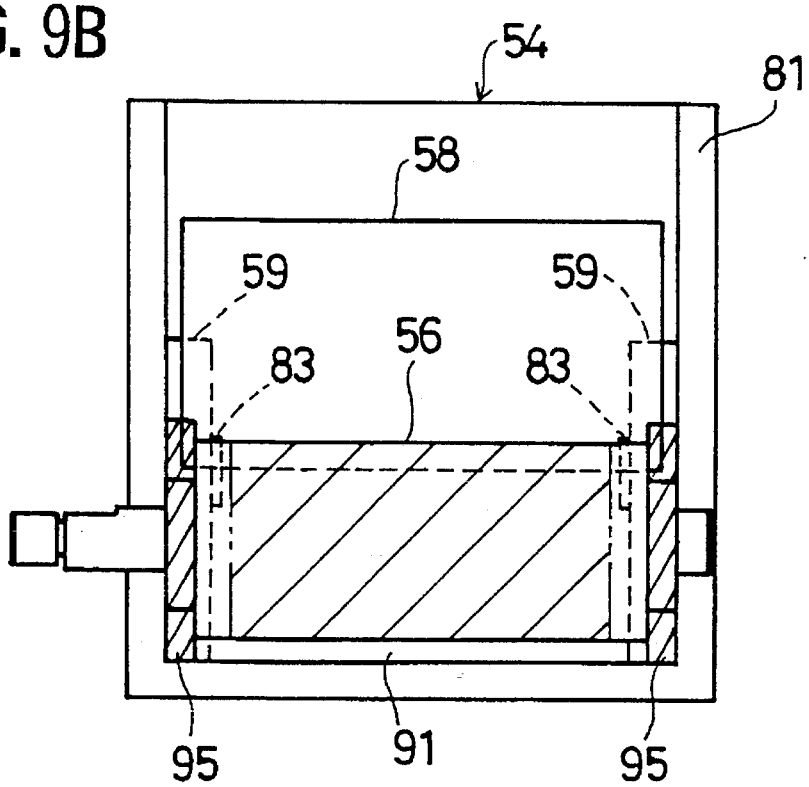
FIG. 9B is a plan view showing the developing device.

FIGS. 9A and 9B are schematic illustrations showing a third embodiment of the present invention, in which FIG. 9A is a sectional view showing a developing device of an electrophotographic device and FIG. 9B is a plan view showing thereof.

In the developing device of the third embodiment, a second agitating member 95 is provided at both ends of the developing roller 56. The second agitating member 95 rotates on the rotation axis of the developing roller 56, as shown in FIGS. 9A and 9B. The diameter of the second agitating members 95 is larger than that of the developing roller 56. According to the third embodiment, the toner 55 which overflows to both ends of the developing roller 56 from the gap D1, shown in FIG. 7B, is agitated to prevent the toner from remaining thereon and to deposit the toner in the space portion 91. That is, the second agitating member 95 functions similarly to the agitation member 82 of the second embodiment. According to the third embodiment, the overflow toner 55 is prevented from remaining on the recording drum 51 and the image quality can be improved.

In the first, second and third embodiments described above, the present invention is utilized in a serial-type electrophotographic device. However, the present invention can be utilized in other types of electrophotographic device such as line printers or page printers.

Further, the present invention is not limited to these embodiments, but various variations and modifications may be made without departing from the scope of the present invention.

What is claimed is:

1. An electrophotographic device comprising:

feeding means for feeding recording paper;

process means, having an image carrier and a developing device, for forming a latent image on the image carrier and developing said latent image to a visible image by image material through said developing device;

transcription means for transcribing said visible image to said recording paper; and photographic fixing means for fixing said visible image transcribed to said recording paper, wherein said developing device contacts said image carrier to develop said visible image by said image material, said developing device having a developing member wider than at least an effective imaging area of said image carrier and narrower than a charged area of said image carrier.

2. The electrophotographic device according to claim 1, wherein said developing member has a contacting portion for adjusting a thickness of said image material supplied thereto, said contacting portion being wider than said developing member.

3. The electrophotographic device according to claim 1, further comprising sealing members for preventing part of said image material which contacts an end portion of said developing member from overflowing, said sealing members being provided at both ends of said developing material.

4. The electrophotographic device according to claim 2, further comprising sealing members for preventing part of said image material which contacts an end portion of said developing member from overflowing, said sealing members being provided at both ends of said developing material.

5. The electrophotographic device according to claim 3, wherein each of said sealing members has a projecting portion for adjusting an amount of said image material to be supplied to said developing device, said projecting portion being provided adjacent said contacting portion.

6. The electrophotographic device according to claim 4, wherein each of said sealing members has a projecting portion for adjusting an amount of said image material to be supplied to said developing device, said projecting portion being provided adjacent said contacting portion.

7. The electrophotographic device according to claim 2, wherein said contacting portion is laterally displaced to a side of the developing member which is opposite to the image carrier.

8. The electrophotographic device according to claim 1, further comprising agitating members for agitating said image material which overflows from both end surfaces of said developing member, said agitating members being provided at said both end surfaces of said developing member.

9. The electrophotographic device according to claim 3, further comprising a space portion for depositing part of said image material overflow from said both end surfaces of said developing member, said space portion formed under said developing member.

10. The electrophotographic device according to claim 4, further comprising a space portion for depositing part of said image material overflow from said both end surfaces of said developing member, said space portion formed under said developing member.

11. The electrophotographic device according to claim 9, wherein said space portion is laterally displaced to a side of the developing member which is opposite to the image carrier.

12. The electrophotographic device according to claim 10, wherein said space portion is laterally displaced to a side of the developing member which is opposite to the image carrier.

13. The electrophotographic device according to claim 9, further comprising transferring means for transferring said part of the image material deposited in said space portion to an area in which said image material is originally stored.

14. The electrophotographic device according to claim 10, further comprising transferring means for transferring said part of the image material deposited in said space portion to an area in which said image material is originally stored.

15. The electrophotographic device according to claim 11, further comprising transferring means for transferring said part of the image material deposited in said space portion to an area in which said image material is originally stored.

16. The electrophotographic device according to claim 12, further comprising transferring means for transferring said part of the image material deposited in said space portion to an area in which said image material is originally stored.

17. The electrophotographic device according to claim 13, wherein said transferring means and said developing member are in synchronism with each other, said electrophotographic device further comprising a rotating member for transferring said image material to said developing member.

18. The electrophotographic device according to claim 15, wherein said transferring means and said developing member are in synchronism with each other, said electrophotographic device further comprising a rotating member for transferring said image material to said developing member.

19. The electrophotographic device according to claim 1, further comprising:

a carriage for mounting said process means; and conveyer means for conveying said carriage in a perpendicular direction to the feeding direction of the recording paper on said transcription means.

20. The electrophotographic device according to claim 19, wherein said photographic fixing means is mounted on said carriage.

* * * * *